US006639165B1

(12) United States Patent
Newman et al.

(10) Patent No.: US 6,639,165 B1
(45) Date of Patent: Oct. 28, 2003

(54) MULTIPLE CONTACT FLUID PRESSURE SWITCH

(75) Inventors: Robert A. Newman, El Paso, TX (US); Francisco J. Sanchez, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/281,655

(22) Filed: Oct. 28, 2002

(51) Int. Cl.[7] ..... H01H 35/40
(52) U.S. Cl. ..... 200/834; 200/512
(58) Field of Search ..... 200/310, 314, 200/512, 517, 341, 345, 308, 313, 1 B

(56) References Cited

U.S. PATENT DOCUMENTS 3,584,168 A * 6/1971 Halpert et al. ..... 200/83 R
3,585,328 A * 6/1971 Fiore et al. ..... 337/320
4,767,943 A * 8/1988 Adler et al. ..... 307/119
4,771,143 A * 9/1988 Hoffmann ..... 200/512
5,177,579 A * 1/1993 Jerman ..... 73/724
5,802,911 A * 9/1998 Cahill et al. ..... 73/727
6,194,678 B1 * 2/2001 Yoshikawa et al. ..... 200/512

FOREIGN PATENT DOCUMENTS

JP 402024929 * 1/1990
JP 402223119 * 9/1990

* cited by examiner

*Primary Examiner*—Lincoln Donovan
*Assistant Examiner*—Lisa Klaus
(74) *Attorney, Agent, or Firm*—Margaret A. Dobrowitsky

(57) ABSTRACT

A multiple contact fluid pressure switch includes a plate from which a rib extends to establish a cavity on the plate. Two lower contacts are on the plate within the cavity. A diaphragm is disposed on the rib to enclose the cavity. Further, an upper contact is disposed on the diaphragm directly above the lower contacts. The multiple contact fluid pressure switch is movable between an open position wherein the upper contact does not engage the lower contacts, a first closed position wherein the upper contact engages one lower contact, and a second closed position wherein the upper contact engages both lower contacts.

25 Claims, 2 Drawing Sheets

MULTIPLE CONTACT FLUID PRESSURE SWITCH

TECHNICAL FIELD

The present invention relates generally to fluid pressure switches.

BACKGROUND OF THE INVENTION

Tire pressure sensors are standard equipment on many vehicles manufactured today. The tire pressure sensors can alert drivers when the tire air pressure becomes dangerously low and avert the likelihood of an accident caused by low tire pressure.

Typical pressure measurement sensors use a piezo-resistive silicon-based pressure sensing element for measuring fluid pressure. Unfortunately, these sensors can consume a considerable amount of current from sources used to power them. For some applications, e.g., tire pressure sensing, a very small battery is used as the power source and the life of the battery is a very important design factor. As recognized herein, by using a pressure activated switch, the sensor circuitry can be modified to minimize the amount of current required to operate the sensor and thus, reduce the electronic overhead of the sensor. With fewer required components, manufacturing costs are reduced.

It happens that fluid pressure activated switches are available. However, since these switches only include a single trip point and are actuated at only a single pressure value, a single fluid pressure activated switch cannot be used to report multiple pressure values in a system.

The present invention has recognized these prior art drawbacks, and has provided the below-disclosed solutions to one or more of the prior art deficiencies.

SUMMARY OF THE INVENTION

A multiple contact fluid pressure switch includes a plate. A rib extends from the plate to establish a cavity on the plate. Two lower contacts are installed in the cavity. A diaphragm encloses the cavity. An upper contact is disposed on the diaphragm. The multiple contact fluid pressure switch is movable between an open position wherein the upper contact does not engage the lower contacts, a first closed position wherein the upper contact engages only one lower contact, and a second closed position wherein the upper contact engages both lower contacts. In a preferred embodiment, the diaphragm is disposed on the rib.

In one aspect of the present invention, a central rib extends from the plate and divides the cavity into a first cavity and a second cavity. A first lower contact is disposed within the first cavity and a second lower contact is disposed within the second cavity. Moreover, the diaphragm is a first diaphragm that encloses the first cavity and the second cavity, and the switch further includes a second diaphragm that is affixed to the first diaphragm. The second diaphragm spans the area above the second cavity. In this aspect of the present invention, the switch includes a first upper contact that is affixed to the first diaphragm above the first lower contact and a second upper contact that is affixed to the first diaphragm above the second lower contact. The switch is movable between an open position wherein the upper contacts do not engage the lower contacts, a first closed position wherein the first upper contact engages the first lower contact, and a second closed position wherein the first upper contact continues to engage the first lower contact and wherein the second upper contact engages the second lower contact.

In yet another aspect of the present invention, the multiple contact fluid pressure switch includes a central lower contact and a first outer lower contact spaced from the central lower contact. Moreover, the upper contact is a common upper contact that is affixed to the diaphragm above the central lower contact and the first outer lower contact. In this aspect, the switch further includes a second outer lower contact placed below the common upper contact. The switch is movable between an open position wherein the common upper contact does not engage the lower contacts, a first closed position wherein the common upper contact engages the central lower contact, and a second closed position wherein the common upper contact continues to engage the central lower contact and wherein the common upper contact engages at least one of the outer lower contacts.

In still another aspect of the present invention, the multiple contact fluid pressure switch includes a central lower contact and an outer lower contact spaced from the central lower contact and surrounding the central lower contact. The upper contact is a common upper contact that is affixed to the diaphragm above the central lower contact and the outer lower contact. In this aspect, the multiple contact fluid pressure switch is movable between an open position wherein the common upper contact does not engage the lower contacts, a first closed position wherein the common upper contact engages the central lower contact, and a second closed position wherein the common upper contact continues to engage the central lower contact and wherein the common upper contact engages at least a portion of the outer lower contact.

In yet still another aspect of the present invention, a fluid pressure switch includes a cavity. Two lower contacts are disposed within the cavity. A diaphragm encloses the cavity. An upper contact is disposed on the diaphragm above the lower contacts. In this aspect, the fluid pressure switch is movable between an open position wherein the upper contact does not engage the lower contacts, a first closed position wherein the upper contact engages one lower contact, and a second closed position wherein the upper contact engages both lower contacts.

The present invention will now be described, by way of example, with reference to the accompanying drawings, in which:

DESCRIPTION OF AN EMBODIMENT OF THE INVENTION

Figure 1:
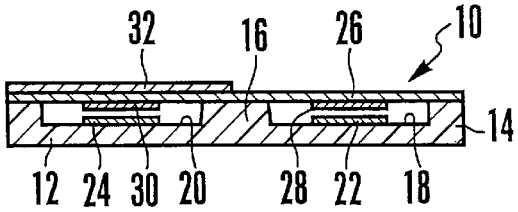
FIG. 1 is a cross-section view of a multiple contact fluid pressure switch in the open position.

Referring initially to FIGS. 1–4, a multiple contact fluid pressure switch is shown and generally designated 10. In a preferred embodiment, the multiple contact fluid pressure switch 10 is manufactured using micro-electro-mechanical systems (MEMS) technology which offers the most reliable method for building the multiple contact fluid pressure switch 10, described in detail below.

FIGS. 1–4 show that the multiple contact fluid pressure switch 10 includes a preferably glass, flat, rectilinear plate 12 having a peripheral rib 14 extending from the upper surface of the plate 12 around the outer periphery of the upper surface. A central rib 16 extends from one side of the peripheral rib 14 to the opposite side of the peripheral rib 14 to establish a first cavity 18 and second cavity 20 above the plate 12 within the confines of the peripheral rib 14.

As shown in FIGS. 1–4, a preferably gold first lower contact 22 is affixed to the upper surface of the plate 12 within the first cavity 18 and extends from within the first cavity 18 through the peripheral rib 14. Also, a preferably gold second lower contact 24 is affixed to the upper surface of the plate 12 within the second cavity 20 and extends from within the second cavity 20 through the peripheral rib 14.

Figure 2:
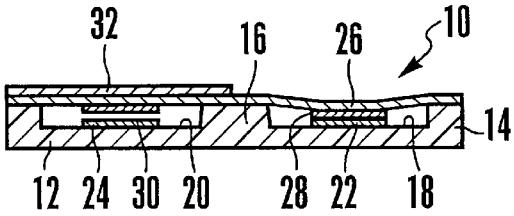
FIG. 2 is a cross-section view of the multiple contact fluid pressure switch in the first closed position.
Figure 3:
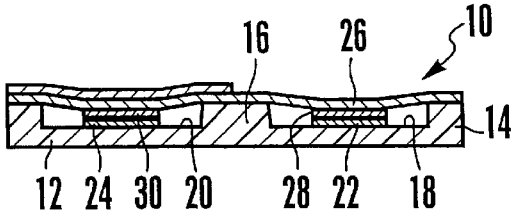
FIG. 3 is a cross-section view of a multiple contact fluid pressure switch in the second closed position.

FIGS. 1–3 show that a preferably resilient, first diaphragm 26 is disposed on top of the peripheral rib 14 and the central rib 16 so that it completely encloses the first cavity 18 and the second cavity 20. In a preferred embodiment, the cavities 18, 20 are airtight. Moreover, a first upper contact 28 is attached to the interior surface of the diaphragm directly above the first lower contact 22. Also, a second upper contact 30 is attached to the interior surface of the first diaphragm 26 above the second lower contact 24 so that it can engage the second lower contact, as described below. FIGS. 1–3 also show that in a preferred embodiment, a preferably resilient, second diaphragm 32 is installed over a portion of the first diaphragm 26, specifically over the second cavity 20. This effectively increases the thickness of diaphragm material over the cavity and as described below, increases the pressure required to engage the second upper contact 30 with the second lower contact 24.

It is to be understood that as the external pressure increases, the multiple contact fluid pressure switch 10 moves between an open position shown in FIG. 1, a first closed position shown in FIG. 2, and a second closed position shown in FIG. 3. Specifically, as the pressure overcomes the stiffness of the first diaphragm 26 over the first cavity 18 the first diaphragm 26 is pushed into the first cavity 18 until the first upper contact 28 engages the first lower contact 22 such that the multiple contact fluid pressure switch 10 is in the first closed position. Moreover, as the pressure continues to increase and overcomes the combined stiffness of the first diaphragm 26 and the second diaphragm 32 over the second cavity 20, the first diaphragm 26 and the second diaphragm 32 are pushed into the second cavity 20 until the second upper contact 30 engages the second lower contact 24 such that the multiple contact fluid pressure switch 10 is in the second closed position.

According to the present invention, the multiple contact fluid pressure switch 10 can be installed in a pressurized environment, e.g., a tire. Accordingly, as the pressure decreases in the tire, e.g., due to a hole in the tire, the second upper contact 30 will disengage the second lower contact 24 and open a circuit causing a warning to be sent to a driver. As the pressure continues to decrease, the first upper contact 28 will disengage the first lower contact and open another circuit causing a second warning to be sent to the driver. Accordingly, it can be appreciated that the multiple contact fluid pressure switch 10 detects decreasing fluid pressure in addition to increasing fluid pressure. It is to be understood that the multiple contact fluid pressure switch 10 can have more than two cavities and with each additional cavity the overall diaphragm thickness above each additional cavity is increased incrementally. Further, the multiple contact fluid pressure switch 10, e.g., the contacts 22, 24, 28, 30 can be integrated with an application specific integrated circuit (ASIC).

Referring to FIGS. 5–8, an alternative multiple contact fluid pressure switch is shown and generally designated 50. FIGS. 5–8 show that the multiple contact fluid pressure switch 50 includes a preferably glass, flat, rectilinear plate 52 having a peripheral rib 54 extending from the upper surface of the plate 52 around the outer periphery of the upper surface to establish a cavity 56 above the plate 52 within the confines of the peripheral rib 54.

As shown in FIGS. 5–8, a preferably gold central lower contact 58 is affixed to the upper surface of the plate 52 within the cavity 56 and extends from within the cavity 56 through the peripheral rib 54. Also, a preferably gold first outer lower contact 60 and second outer lower contact 62 are affixed to the upper surface of the plate 52 within the cavity 56 such that they flank the central lower contact 58. As shown, the outer lower contacts 60, 62 also extend from within the cavity 56 through the peripheral rib 54.

Figure 5:
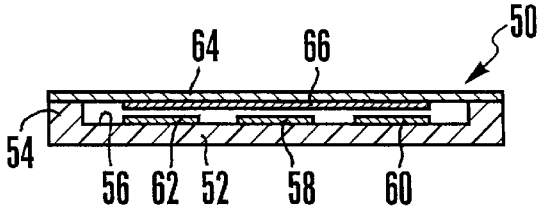
FIG. 5 is a cross-section view of a first alternative multiple contact fluid pressure switch in the open position.
Figure 6:
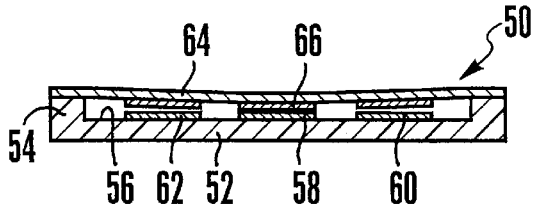
FIG. 6 is a cross-section view of the first alternative multiple contact fluid pressure switch in the first closed position.
Figure 7:
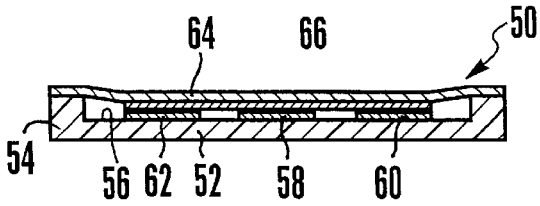
FIG. 7 is a cross-section view of the first alternative multiple contact fluid pressure switch in the second closed position.
Figure 4:
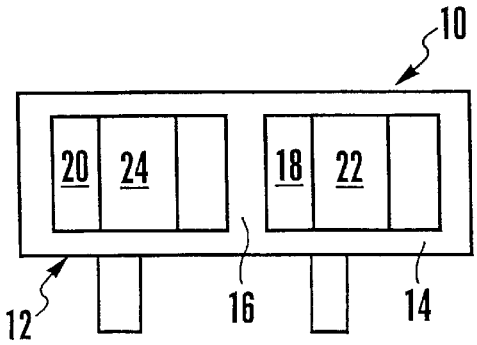
FIG. 4 is a top plan view of the multiple contact fluid pressure switch with the diaphragm and upper contacts removed for clarity.
Figure 8:
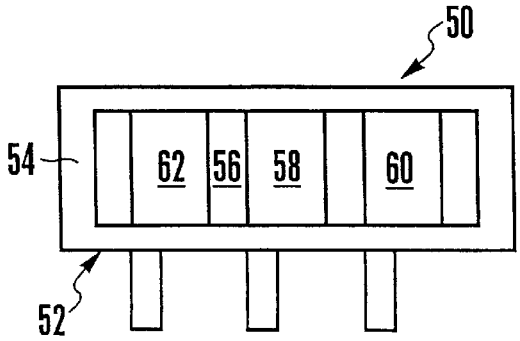
FIG. 8 is a top plan view of the first alternative multiple contact fluid pressure switch with the diaphragm and common contact removed for clarity.

FIGS. 5–7 show that a diaphragm 64 is disposed on top of the peripheral rib 54 so that it completely encloses the cavity 56. Preferably, the cavity 56 is airtight. As shown, a preferably gold, flexible common upper contact 66 is attached to the interior surface of the diaphragm 64 directly above the central lower contact 58 and the outer lower contacts 60, 62. As described below, the common upper contact 66 can engage the central lower contact 58 and the outer lower contacts 60, 62.

It is to be understood that as the external pressure increases, the multiple contact fluid pressure switch 50 moves between an open position shown in FIG. 5, a first closed position shown in FIG. 6, and a second closed position shown in FIG. 7. Specifically, as the pressure overcomes the stiffness of the diaphragm 64 over the cavity 56 the diaphragm 64 is partially pushed into the cavity 56 until the common upper contact 66 engages the central lower contact 58 such that the multiple contact fluid pressure switch 50 is in the first closed position. Moreover, as the pressure continues to increase, it continues to push the diaphragm 64 into the cavity 56 until the common upper contact 66 engages the outer lower contacts 60, 62 such that the multiple contact fluid pressure switch 50 is in the second closed position.

Referring now to FIGS. 9–12, a second alternative multiple contact fluid pressure switch is shown and generally designated 100. FIGS. 9–12 show that the multiple contact fluid pressure switch 100 includes a preferably glass, flat, rectilinear plate 102 having a peripheral rib 104 extending from the upper surface of the plate 102 around the outer periphery of the upper surface to establish a cavity 106 above the plate 102 within the confines of the peripheral rib 104. In a preferred embodiment, the cavity 106 is airtight.

As shown in FIGS. 9–12, a preferably gold central lower contact 108 is affixed to the upper surface of the plate 102 within the cavity 106 and extends from within the cavity 106 through the peripheral rib 104. Also, a preferably gold outer lower contact 110 is affixed to the upper surface of the plate 102 within cavity 106 such that it surrounds the central lower contact 108. As shown, the outer lower contact 108 also extends from within the cavity 106 through the peripheral rib 104.

Figure 9:
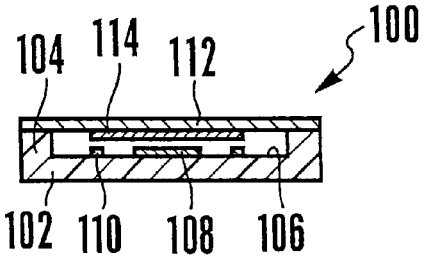
FIG. 9 is a cross-section view of a second alternative multiple contact fluid pressure switch in the open position.
Figure 10:
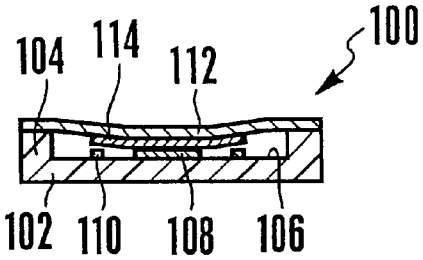
FIG. 10 is a cross-section view of the second alternative multiple contact fluid pressure switch in the first closed position.
Figure 11:
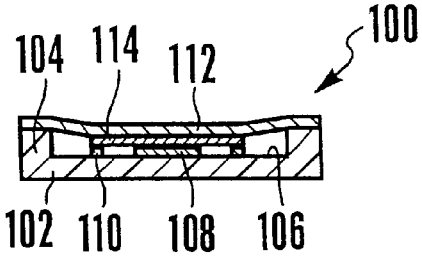
FIG. 11 is a cross-section view of a the second alternative multiple contact fluid pressure switch in the second closed position.
Figure 12:
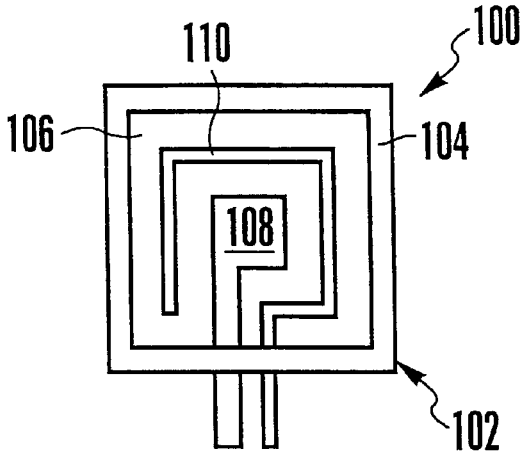
FIG. 12 is a top plan view of the second alternative multiple contact fluid pressure switch with the diaphragm and common contact removed for clarity.

FIGS. 9–11 show that a diaphragm 112 is disposed on top of the peripheral rib 104 so that it completely encloses the cavity 106. Preferably, the cavity 106 is airtight. As shown, a preferably gold, flexible common upper contact 114 is attached to the interior surface of the diaphragm 112 directly above the central lower contact 108 and the outer lower contact 110. As described below, the common upper contact 114 can engage the central lower contact 108 and the outer lower contact 110.

It is to be understood that as the external pressure increases, the multiple contact fluid pressure switch 100 moves between an open position shown in FIG. 9, a first closed position shown in FIG. 10, and a second closed position shown in FIG. 11. Specifically, as the pressure overcomes the stiffness of the diaphragm, the diaphragm 112 is partially pushed into the cavity 106 until the common upper contact 114 engages the central lower contact 108 such that the multiple contact fluid pressure switch 100 is in the first closed position. Moreover, as the pressure continues to increase, it continues to push the diaphragm 112 into the cavity 106 until the common upper contact 114 engages the outer lower contact 110 such that the multiple contact fluid pressure switch 100 is in the second closed position.

With the configuration of structure described above, it is to be appreciated that the multiple contact fluid pressure switch 10, 50, 100 provides a pressure activated switch having multiple contacts. Moreover, the configuration of the multiple contact fluid pressure switch 10, 50, 100 minimizes the amount of current required to operate circuitry connected thereto. Also, providing a multiple contact multiple contact fluid pressure switch 10, 50, 100 for use in systems that do not require the full range measurement capabilities of piezoresistive pressure sensors allows the use of all digital electronics which reduce production costs.

While the particular MULTIPLE CONTACT FLUID PRESSURE SWITCH as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

We claim:

1. A multiple contact fluid pressure switch, comprising:

a plate;

a rib extending from the plate to establish a cavity on the plate;

two lower contacts in the cavity;

a diaphragm enclosing the cavity; and an upper contact disposed on the diaphragm, the multiple contact fluid pressure switch being movable between an open position wherein the upper contact does not engage the lower contacts, a first closed position wherein the upper contact engages only one lower contact, and a second closed position wherein the upper contact engages both lower contacts.

2. The multiple contact fluid pressure switch of claim 1, wherein the diaphragm is disposed on the rib.

3. The multiple contact fluid pressure switch of claim 2, further comprising:

a central rib extending from the plate, the central rib dividing the cavity into a first cavity and a second cavity;

a first lower contact being disposed within the first cavity; and a second lower contact being disposed within the second cavity.

4. The multiple contact fluid pressure switch of claim 3, wherein the diaphragm is a first diaphragm that encloses the first cavity and the second cavity and the switch further comprises:

a second diaphragm affixed to the first diaphragm, the second diaphragm spanning the area above the second cavity.

5. The multiple contact fluid pressure switch of claim 4, further comprising:

a first upper contact affixed to the first diaphragm above the first lower contact; and a second upper contact affixed to the first diaphragm above the second lower contact.

6. The multiple contact fluid pressure switch of claim 5, wherein the switch is movable between an open position wherein the upper contacts do not engage the lower contacts, a first closed position wherein the first upper contact engages the first lower contact, and a second closed position wherein the first upper contact continues to engage the first lower contact and wherein the second upper contact engages the second lower contact.

7. The multiple contact fluid pressure switch of claim 2, wherein the lower contacts comprise:

a central lower contact; and a first outer lower contact spaced from the central lower contact.

8. The multiple contact fluid pressure switch of claim 7, wherein the upper contact is a common upper contact that is affixed to the diaphragm above the central lower contact and the first outer lower contact.

9. The multiple contact fluid pressure switch of claim 8, further comprising:

a second outer lower contact placed below the common upper contact.

10. The multiple contact fluid pressure switch of claim 9, wherein the switch is movable between an open position wherein the common upper contact does not engage the lower contacts, a first closed position wherein the common upper contact engages the central lower contact, and a second closed position wherein the common upper contact continues to engage the central lower contact and wherein the common upper contact engages at least one of the outer lower contacts.

11. The multiple contact fluid pressure switch of claim 1, wherein the lower contacts comprise:

a central lower contact; and an outer lower contact spaced from the central lower contact and surrounding the central lower contact.

12. The multiple contact fluid pressure switch of claim 11, wherein the upper contact is a common upper contact that is affixed to the diaphragm above the central lower contact and the outer lower contact.

13. The multiple contact fluid pressure switch of claim 12, wherein the switch is movable between an open position wherein the common upper contact does not engage the lower contacts, a first closed position wherein the common upper contact engages the central lower contact, and a second closed position wherein the common upper contact continues to engage the central lower contact and wherein the common upper contact engages at least a portion of the outer lower contact.

14. A fluid pressure switch, comprising:

a cavity;

two lower contacts disposed within the cavity;

a diaphragm enclosing the cavity; and an upper contact disposed on the diaphragm above the lower contacts, the fluid pressure switch being movable between an open position wherein the upper contact does not engage the lower contacts, a first closed position wherein the upper contact engages one lower contact, and a second closed position wherein the upper contact engages both lower contacts.

15. The fluid pressure switch of claim 14, comprising:

a first cavity and a second cavity;

a first lower contact being disposed within the first cavity; and a second lower contact being disposed within the second cavity.

16. The fluid pressure switch of claim 15, wherein the diaphragm is a first diaphragm that encloses the first cavity and the second cavity and the switch further comprises:

a second diaphragm affixed to the first diaphragm, the second diaphragm spanning the area above the second cavity.

17. The fluid pressure switch of claim 16, further comprising:

a first upper contact affixed to the first diaphragm above the first lower contact; and a second upper contact affixed to the first diaphragm above the second lower contact.

18. The fluid pressure switch of claim 17, wherein the switch is movable between an open position wherein the upper contacts do not engage the lower contacts, a first closed position wherein the first upper contact engages the first lower contact, and a second closed position wherein the first upper contact continues to engage the first lower contact and wherein the second upper contact engages the second lower contact.

19. The fluid pressure switch of claim 13, wherein the lower contacts comprise:

a central lower contact; and a first outer lower contact spaced from the central lower contact.

20. The fluid pressure switch of claim 19, wherein the upper contact is a common upper contact that is affixed to the diaphragm above the central lower contact and the first outer lower contact.

21. The fluid pressure switch of claim 20, further comprising:

a second outer lower contact placed below the common upper contact.

22. The fluid pressure switch of claim 21, wherein the switch is movable between an open position wherein the common upper contact does not engage the lower contacts, a first closed position wherein the common upper contact engages the central lower contact, and a second closed position wherein the common upper contact continues to engage the central lower contact and wherein the common upper contact engages at least one of the outer lower contacts.

23. The fluid pressure switch of claim 14, wherein at least one of the lower contacts comprise:

a central lower contact; and an outer lower contact spaced from the central lower contact and surrounding the central lower contact.

24. The fluid pressure switch of claim 23, wherein the upper contact is a common upper contact that is affixed to the diaphragm above the central lower contact and the outer lower contact.

25. The fluid pressure switch of claim 24, wherein the switch is movable between an open position wherein the common upper contact does not engage the lower contacts, a first closed position wherein the common upper contact engages the central lower contact, and a second closed position wherein the common upper contact continues to engage the central lower contact and wherein the common upper contact engages at least a portion of the outer lower contact.

* * * * *